US005732628A

United States Patent [19]

Kemmerer et al.

[11] Patent Number: 5,732,628

[45] Date of Patent: Mar. 31, 1998

[54] SHEET-CONVEYING DRUM FOR PRINTING MACHINES

[75] Inventors: Klemens Kemmerer, Seligenstadt; Franz-Peter Richter, Frankisch-Crumbach; Harald Bayer, Rodgau, all of Germany

[73] Assignee: MAN Roland Druckmaschinen AG, Germany

[21] Appl. No.: 529,516

[22] Filed: Sep. 18, 1995

[30] Foreign Application Priority Data

Sep. 23, 1994 [DE] Germany ..... 44 33 998.4

[51] Int. Cl.[6] ..... B41F 1/30

[52] U.S. Cl. ..... 101/409; 101/408

[58] Field of Search ..... 101/409, 110, 101/408, 407.1, 416.1; 271/277, 314, 82, 85, 204, 205, 206

[56] References Cited

U.S. PATENT DOCUMENTS

| | | | |
|---|---|---|---|
| 3,782,280 | 1/1974 | Jurny et al. | 101/246 |
| 3,985,074 | 10/1976 | Bonsch | 101/246 |
| 5,324,023 | 6/1994 | Fedorjaka | 271/277 |
| 5,465,663 | 11/1995 | Bayer et al. | 101/409 |

FOREIGN PATENT DOCUMENTS

| | | | |
|---|---|---|---|
| 0043424 | 1/1982 | European Pat. Off. | 101/409 |
| 0143149 | 8/1980 | Germany | 101/409 |
| 34 28 668 C2 | 4/1989 | Germany . | |
| 42 33 422 C1 | 1/1994 | Germany . | |
| 2 098 966 | 12/1982 | United Kingdom . | |

*Primary Examiner*—Edgar S. Burr
*Assistant Examiner*—Anthony H. Nguyen
*Attorney, Agent, or Firm*—Leydig, Voit & Mayer, Ltd.

[57] ABSTRACT

A sheet-conveying drum for use between units in a printing machine is provided with a plurality of gripper bridges arranged substantially circumferentially symmetrically on the drum surface. The gripper bridges hold the paper on the drum and include gripper impact strips that are adjustable substantially radially relative to the drum in order to accommodate printing materials of different thickness. Each gripper impact strip is adjusted by means of a positioning device that is arranged on the drum radially inward of the gripper impact strip and mounted so that it can move axially relative to the drum and cam the gripper impact strip radially. The axial movement of the positioning devices is brought about by two actuating devices which are mounted opposite each other on the side frames of the printing machine. The actuating devices are preferably pneumatic cylinders and are adapted so that when they are extended they periodically engage adapters on the free ends of the positioning devices as the drum rotates. When the extended actuating device engages the adaptor the actuating device cams the positioning devices in the axial direction thereby causing the gripper impact strips to move in the radial direction.

10 Claims, 1 Drawing Sheet

SHEET-CONVEYING DRUM FOR PRINTING MACHINES

FIELD OF THE INVENTION

The present invention relates generally to printing machines, and more particularly to a sheet-conveying drum in a sheet-processing printing machine.

BACKGROUND OF THE INVENTION

Typically, sheet-conveying drums are located between the printing units and between the further-processing units, such as varnishing works, of a rotary printing machine. A sheet-conveying drum generally has one or more gripper bridges that are distributed evenly about the circumferential surface of the drum. These gripper bridges hold the sheets of paper to the drum enabling the drum to convey the sheets from the previous unit to the next unit downstream in the printing machine. In order to accommodate sheets of different thickness, the gripper bridges have adjustable gripper impact strips.

A sheet-conveying drum of this type is known from DE 3,428,668 C2, in which the drum has a central adjustment mechanism for adjusting the gripper pads in each of the gripper bridges to accommodate sheets of different thickness. The central adjustment mechanism is arranged on the drum body and acts on a positioning mechanism which acts on means that simultaneously adjusts all of the gripper pads. Further, the central adjustment mechanism can be driven by a motor and controlled from a control panel. However, the central adjustment mechanism is not capable of separately adjusting each individual gripper pad. An individual adjustment of each gripper impact strip can only be accomplished by releasing the retained central adjustment mechanism and manually adjusting the individual gripper impact strips. Since it is not easy to individually adjust each gripper pad, inaccuracies in sheet receiving or sheet transferring between sheet transfer cylinders cannot be effectively remedied. This could lead to slipping or tearing of the sheets which would disrupt the registry of the sheets resulting in lower quality printing. In addition, adjustment of the gripper pads is quite complicated and time consuming, requiring both a basic adjustment step and a fine adjustment step. This leads to increased production down time, since the printing press must be shut down in order to adjust the gripper pads for a new sheet thickness.

GB 2,098,966 A discloses a sheet-conveying cylinder having a mechanism for adjusting the gripper pads in a gripper bridge for sheets of different thickness. The gripper pads for the gripper bridge are mounted on a gripper pad bar which extends axially to the cylinder. The mechanism comprises an adjusting rod which is arranged radially inward of the gripper pad bar and in contacting relation therewith and a plurality of adjustment screws that threadedly extend through the adjustment bar. The contact surfaces of the adjustment bar and the gripper pad bar are complimentarily slanted in the transverse direction of the bars. Angular movement of the adjustment screws causes the adjustment bar to move thereby displacing the gripper pad bar radially inward or outward to accommodate a different sheet thickness. This type of adjustment mechanism is undesirable because a significant amount of time is required to adjust the gripper bridge for a different sheet thickness since several screws must manually adjusted.

OBJECTS AND SUMMARY OF THE INVENTION

It is an object of the invention to provide a sheet-conveying drum that has gripper bridges which can be individually adjusted for printing materials of different thickness.

It is a related object of the invention to provide a sheet-conveying drum that has gripper bridges that can be adjusted quickly and easily with a minimum of down time for the printing machine.

In accordance with these and other objects of the invention, a sheet-conveying drum is provided for use in rotary printing machines. The gripper bridges on the sheet-conveying drum can be adjusted for processing a different printing material by means of positioning devices which are located on the drum and actuating devices which are located on the opposed side frames of the printing machine. Each gripper bridge consists of a gripper shaft, grippers, and gripper impact strips which are adjustable in substantially the radial direction. Each gripper bridge is paired with a positioning device which comprises a positioning rod having a plurality of attached wedge-shaped elements. The positioning rod is arranged on the drum radially inward of the gripper impact strip and is mounted so that it can move axially relative to the drum. The wedge-shaped elements are spring loaded into contacting relation with a plurality of complimentarily slanted wedge-shaped elements on the underside of the gripper impact strip. Thus, axial movement of the positioning rod cams the gripper impact strip in the radial direction.

The axial movement of the positioning devices is brought about by two actuating devices which are mounted opposite each other on the side frames of the printing machine. The actuating devices are positioned on the side frames so that they are flush with the circle formed by the positioning devices as they rotate on the drum. The actuating devices, which are preferably pneumatic cylinders, are arranged so that when they are in their actuated or extended position they periodically engage adapters which are disposed on the free ends of the positioning rods as the drum rotates at its creep speed. When the extended actuating device engages the adaptor, the adaptor cams over a camming surface on the operating end of the cylinder thereby pushing the positioning rod in the axial direction. Thus, the gripper impact strip of each gripper bridge can be individually adjusted radially into two positions. This is achieved by extending one of the actuating devices and rotating the individual gripper bridges past that extended actuating device. The opposite unextended actuating device acts as a stop for the positioning device or the positioning device is retained by some other means after it is moved into a predetermined position by the extended actuating device. In order to move the gripper impact strip back to its original position the opposite actuating device is extended. After the adjustment is complete the actuating devices are returned to their unextended positions.

The adjustment of the gripper bridges can be automated by connecting a sensing device which records the thickness of the printing material being processed and the energy source for the actuating devices into a control panel with appropriate circuitry.

These and other features and advantages of the invention will be more readily apparent upon reading the following description of a preferred exemplified embodiment of the invention and upon reference to the accompanying drawings wherein:

Figure 1:
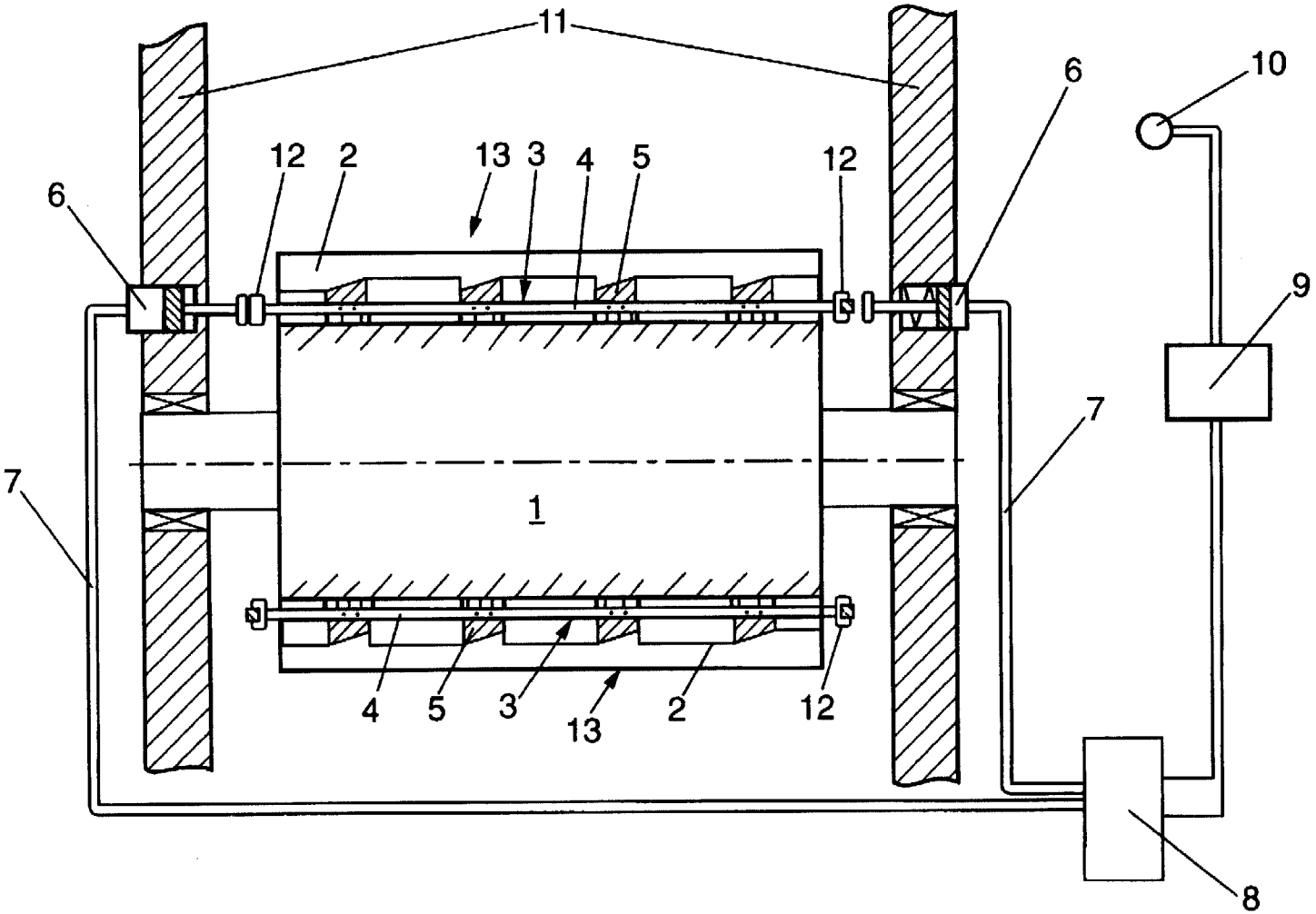
FIG. 1 is a front view of a sheet-conveying drum having two gripper bridges of the present invention.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

FIG. 1 illustrates in schematic form a sheet-conveying drum 1 which is arranged in an offset printing machine between the impression cylinders of two printing units. The illustrated drum 1 is double-sized in relation to a single-size impression cylinder and thus has two gripper bridges 13 arranged circumferentially symmetrically (offset by 180°) on the surface of the drum 1. While the illustrated embodiment is a double-sized sheet-conveying drum it is understood that the present invention is suitable for single-size to quadruple-sized drums having the corresponding number of gripper bridges arranged symmetrically on the surface of the drum. In addition, the invention is suitable for sheet transfer cylinders, pregripper cylinders, and feeder drums. Each gripper bridge 13 consists of a gripper shaft, grippers, and gripper impact strips 2 which are adjustable in substantially the radial direction. For each gripper the gripper impact strip 2 includes associated pad blocks for the individual gripper pads. The drum 1 is rotatably supported by two journals each of which is mounted in a bearing in the opposed side frames 11 of the printing machine.

Each gripper impact strip 2 has an associated positioning means or device 3 that can adjust the gripper impact strip 2 either radially inward or outward depending on the thickness of the printing material. The positioning device 3 is mounted on the drum 1 so that it can move axially relative to the drum. The illustrated double-size drum has two positioning devices arranged on the drum. Each positioning device 3 comprises a positioning rod 4 having a plurality of attached wedge-shaped elements 5 which are slanted longitudinally of the rod 4. The positioning rod 4 is arranged on the body of the drum 1 radially inward of the gripper impact strip 2 and moves axially relative to the drum. The wedge-shaped elements 5 on the positioning rod 4 are in contacting relation with a plurality of complimentarily slanted wedge-shaped elements disposed on the gripper impact strip 2 so that axial movement of the positioning rod 4 cams the gripper impact strip 2 in a substantially radial direction. The complimentary wedge shaped elements on the gripper impact strip 2 and the positioning rod 4 are held in contacting relation with each other by the bias of springs.

A pair of actuating means or devices 6 which bring about the axial movement of the positioning rod 4 are mounted opposite each other on the side frames 11 of the printing machine. The actuating devices 6 are disposed on the side frames 11 so that they are flush with the circle formed by the positioning devices 3 as they rotate on the drum 1. The actuating devices 6 are adapted to periodically engage adapters 12 that are disposed on the free ends of the positioning rod 4. In the preferred embodiment, the actuating devices 6 are pneumatic cylinders which are connected to an energy supply 8, such as a pneumatic system, and have a camming surface on the operating end of the cylinder. Furthermore, the adapters 12 are rotatable rollers that are fastened to the free ends of the positioning rod 4 and disposed towards the camming surface of the actuating cylinder wherein the adapters 12 can be adjusted on the positioning rod 4. Those skilled in the art will appreciate that the actuating devices could also be hydraulic cylinders or electrically powered devices.

The actuating devices 6 can be automated by connecting the air compressor, which comprises the energy supply 8 of the actuating cylinders, to a control panel 9 which receives a signal from a sensing device 10 that records the thickness of printing material being processed. The sensing device 10 is arranged on the printing machine ahead of the first printing unit and can be integrated in a double-sheet control device. However, the invention is not limited to automated adjustment of the gripper impact strips and the adjustment may be controlled manually either at the control panel, the air compressor, or the cylinders themselves.

The mode of operation is as follows: A sheet is fed to the drum 1 by an cylinder in an upstream printing unit. The drum receives the sheet with one of its gripper bridges 13. The sheet is then conveyed and subsequently passed on to an impression cylinder in a downstream printing unit. When it is necessary to process a material having a different thickness the gripper impact strips 2 on the drum 1 have to be adjusted radially either higher or lower. In order to make this adjustment, first, the energy supply 8 to the actuating devices 6, in the preferred embodiment the air compressor, is activated either manually or automatically by the control panel 9 when the sensing device 10 records a different sheet thickness. One of the actuating devices 6, a pneumatic cylinder in the preferred embodiment, is actuated with compressed air via a pneumatic line system 7 thereby causing the piston of one of the actuating devices 6 to extend. The actuating device 6 on the opposite side frame remains held in the unextended position by a restoring spring. The free end of the pistons of the actuating devices 6 are formed with an operating surface which, in the preferred embodiment, is a camming surface.

Once the actuating device 6 is fully extended, the printing machine is set in rotation at the creep speed either manually or automatically through the control panel 9. As the drum 1 rotates, the roller portion of the adapters 12 on the free ends of the positioning devices 3 nearest the extended actuating device 6 roll, successively, over the camming surface of the actuating device thereby pushing the positioning rods 4 in the axial direction. The axial movement of the positioning rods 4 causes the complimentary wedge-shaped elements on the positioning rods 4 and the gripper impact strips 2 to engage thereby camming the gripper impact strips 2 radially either inward or outward depending upon which actuating device 6 is extended. The opposite unextended actuating device 6 serves as a stop for the positioning device 3 or the positioning device 3 can be retained by some other means after the actuating device 6 moves the positioning device 3 into a predetermined position. All of the gripper bridges 13 are thus adjusted in only one rotation of the drum.

In addition, selected gripper bridges 13 can be adjusted independently of the other gripper bridges by rotating only the selected gripper bridges past the extended actuating device. After the adjustment operation is complete the extended actuating device 6 is returned to its unextended position. In order to return the gripper impact strips 2 to their original setting, the opposite actuating device 6 is extended. Therefore, the drum 1 is capable of handling printing material, such as paper and card, with two different thicknesses.

When only one actuating device 6 is actuated at a time the gripper impact strips 2 can only be adjusted into two positions (high and low). An intermediate adjustment can be accomplished by extending both actuating devices 6 at the same time. The actuating devices 6 each have a defined stroke which combine to move the positioning rod 4 in the axial direction resulting in an intermediate radial adjustment of the gripper impact strip 2.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

We claim as our invention:

1. A sheet-conveying drum for conveying sheets of different thickness between two units of a printing machine having opposing side frames comprising, in combination, a plurality of gripper bridges arranged substantially circumferentially symmetrically on the surface of said drum, each of said gripper bridges including a gripper shaft, grippers, and gripper impact strips, wherein said gripper impact strips are adjustable substantially radially relative to said drum, positioning means having opposite ends associated with each of said gripper impact strips for causing said gripper impact strips to be moved in the radial direction relative to said drum when said positioning means is activated, and actuating means disposed on each of said opposing side frames of said printing machine for periodically engaging at least one of said ends of said positioning means to thereby actuate said positioning means as said drum rotates.

2. A sheet-conveying drum as defined in claim 1 wherein said gripper impact strip includes a plurality of wedge-shaped elements attached thereto and said positioning means includes an axially movable positioning rod having a plurality of complimentary wedge-shaped elements attached thereto that are in contacting relation with said plurality of complimentary wedge-shaped elements attached to said gripper impact strip whereby axial movement of said positioning rod acts to cam said gripper impact strip substantially in the radial direction.

3. A sheet-conveying drum as defined in claim 2 including an adaptor disposed on each of said opposite ends of said positioning rod and wherein said adaptor periodically engages said actuating means as said drum rotates.

4. A sheet-conveying drum as defined in claim 3 wherein the axial position of said positioning means can be retained.

5. A sheet-conveying drum as defined in claim 3 wherein said adaptor is adjustable on said positioning rod.

6. A sheet-conveying drum as defined in claim 1 wherein said actuating means are disposed on said opposing side frames flush with a circle formed by said positioning means as said drum rotates.

7. A sheet-conveying drum as defined in claim 3 wherein when said actuating means and said adaptor engage as said drum rotates said actuating means acts to cam said adaptor and said positioning means in substantially the radial direction.

8. A sheet-conveying drum as defined in claim 3 wherein said actuating means opposite said actuating means in engagement with said positioning means limits said axial movement of said positioning rod.

9. A sheet-conveying drum as defined in claim 1 wherein said actuating means includes a pneumatic cylinder.

10. A sheet-conveying drum as defined in claim 3 wherein said actuating means includes an adapter engaging surface having a cam-shaped profile and said adapter includes a cam roller for engaging said adapter surface.

* * * * *